US006311938B1

(12) United States Patent
Lin

(10) Patent No.: US 6,311,938 B1
(45) Date of Patent: Nov. 6, 2001

(54) SUPPORT BASE STRUCTURE FOR A GOLF CLUB BAG

(76) Inventor: Ming-Tsung Lin, 63, Fang Tsao Street, Chan Hua (TW)

( * ) Notice: Subject to any disclaimer, the term of this patent is extended or adjusted under 35 U.S.C. 154(b) by 0 days.

(21) Appl. No.: 09/520,961

(22) Filed: Mar. 8, 2000

(51) Int. Cl.[7] ..... A63B 55/00
(52) U.S. Cl. ..... 248/96; 248/136
(58) Field of Search ..... 248/96, 97, 99, 248/136, 395, 398, 396; 206/315.7, 315.3

(56) References Cited

U.S. PATENT DOCUMENTS

| | | | | |
|---|---|---|---|---|
| 5,540,431 | * | 7/1996 | Crozier | 473/282 |
| 5,634,616 | * | 6/1997 | Wang et al. | 248/96 |
| 5,816,399 | * | 10/1998 | Rhee | 206/315.7 |
| 5,996,789 | * | 12/1999 | Suggs et al. | 206/315.3 |
| 6,010,101 | * | 1/2000 | Stein et al. | 248/96 |
| 6,062,383 | * | 5/2000 | Han | 206/315.7 |
| 6,098,797 | * | 8/2000 | Han | 206/315.7 |

* cited by examiner

*Primary Examiner*—Ramon O. Ramirez
*Assistant Examiner*—A. Joseph Wujciak
(74) *Attorney, Agent, or Firm*—Bacon & Thomas PLLC

(57) ABSTRACT

A support base for a golf club bag. The support base includes an upper base (9). The upper base includes at least one through passage. The support base includes a lower base (2) having an upper portion (2A, 7A) and a lower portion (2B, 7B). The first end of a golf club bag (1) is attached to the upper base (9) and the lower base (2) to form an open cavity between the upper and lower bases. A stand (5) is pivotally connected to the upper base (9) and extends along the length of the golf club bag, near the lower base (2). A support frame (4) is attached to the lower base (2) and pivotally connected to the stand (5). The lower base (2) further includes an opening (21) through which a movable base (3) is slidably attached, such that when the stand (5) is extended outwardly and rests on a ground, the support frame (4) flexes, and the weight of the support base partially rests on the movable base (3) such that the movable base is forced upwards and the support base rests on the ground at a bottom portion of the stand (5), a bottom surface of the movable base (3) and a bottom surface of the lower base (2).

2 Claims, 3 Drawing Sheets

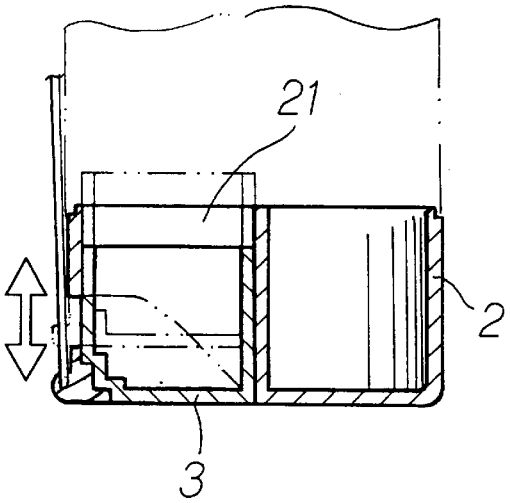
FIG. 2-C
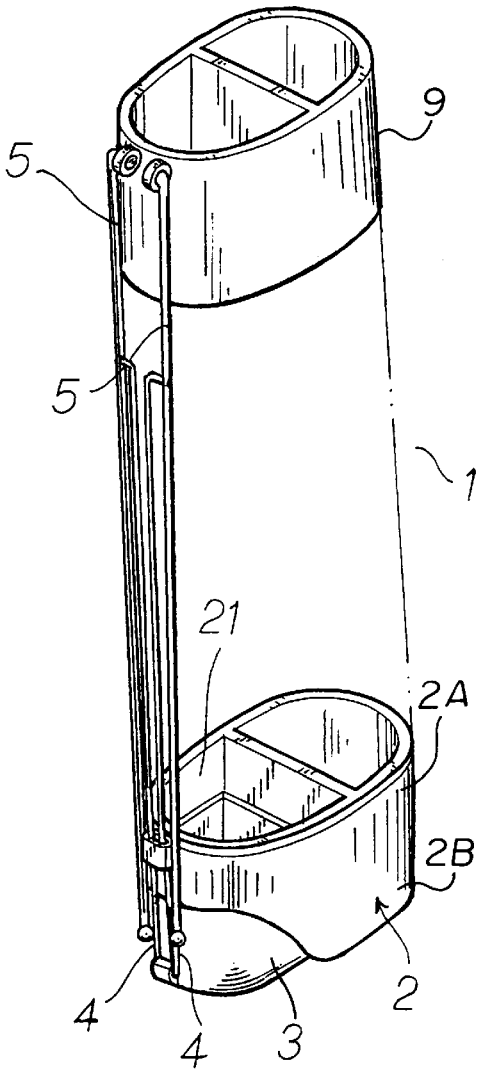
FIG. 2-A
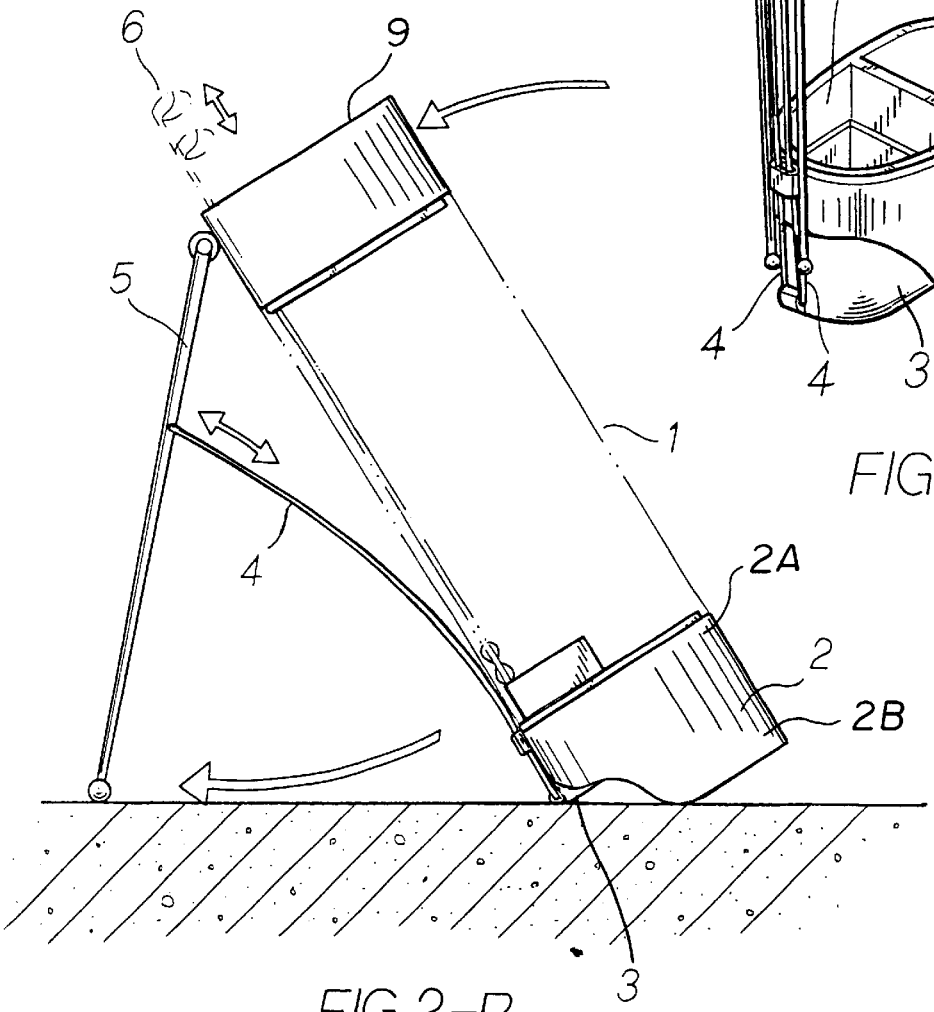
FIG. 2-B

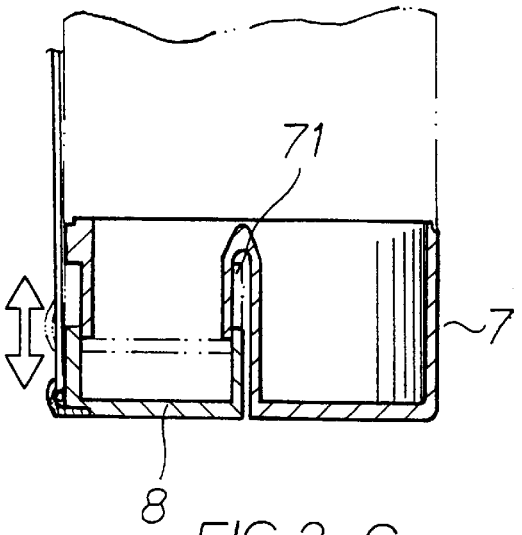
FIG. 3-C
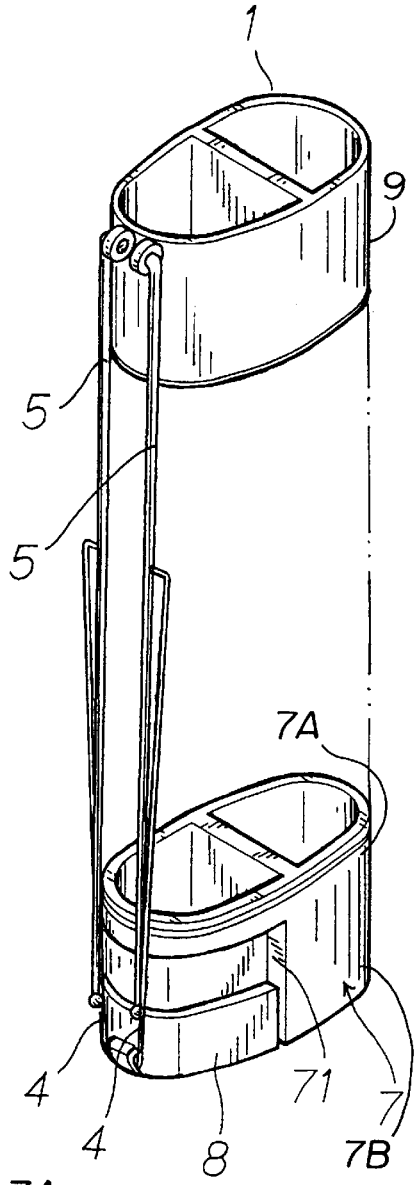
FIG. 3-A
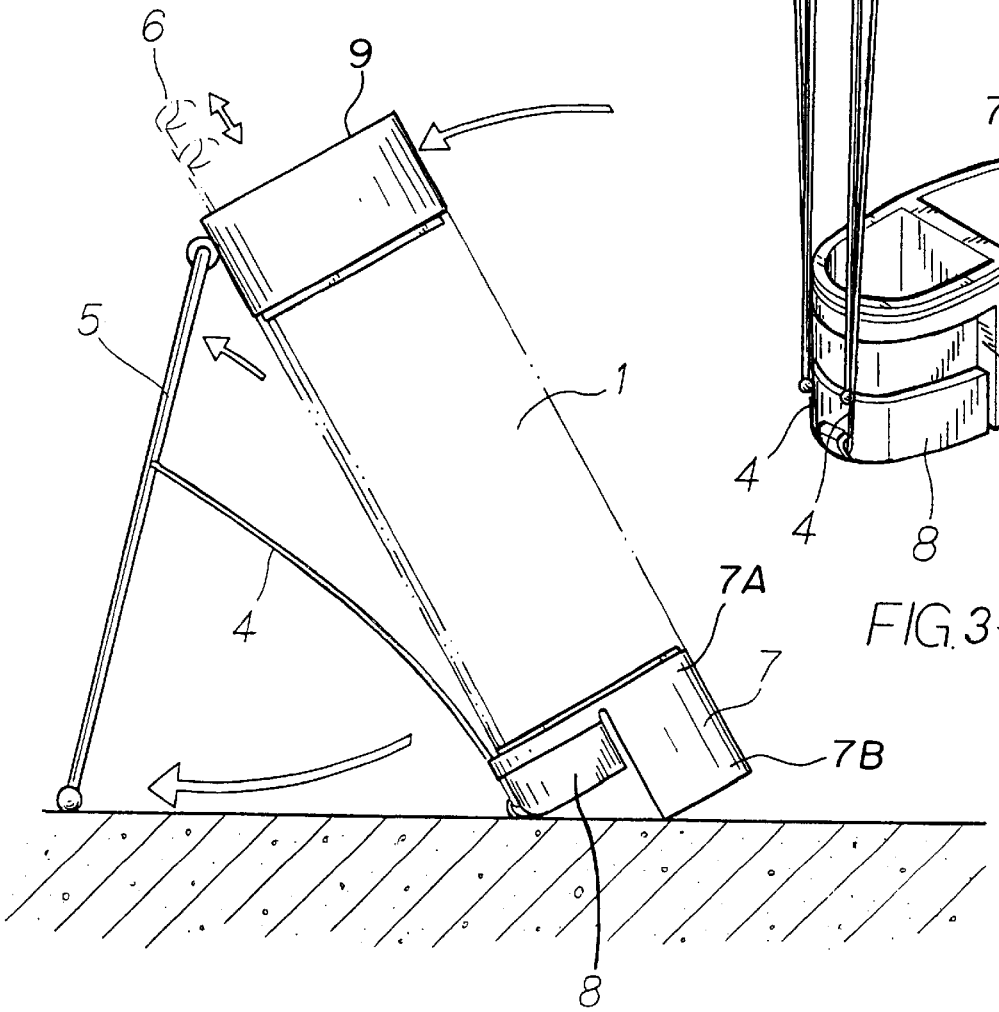
FIG. 3-B

SUPPORT BASE STRUCTURE FOR A GOLF CLUB BAG

BACKGROUND OF THE INVENTION

1. Field of the Invention

The invention is primarily based on a support base for a golf club bag equipping a movable base located on the lateral side of a golf club bag and specifically designed to function with pin connection of a support frame and the stand of a golf club bag. When a support frame is pulled out to move outward against golf club bag, the movable base is forced to slide upward and the whole golf club bag is supported in an appropriate inclined degree. Due to the lifting movement of a movable base, golf clubs in the movable base are thus extended outward to achieve the effects of steady standing of a golf club bag with a certain inclined angle, easy reach of golf clubs for users, and improved overall aesthetics in the outlook of a golf club bag.

2. Description of the Related Art

As known, the prior golf club bags in markets as shown in FIG. 1, are to equip support frame C on the surface of golf club bag A and stand B in radiant shape to firmly slant golf club bag A. When stand B, which functions as pin connection of golf club bag A, is opened, the whole golf club bag is steadily supported with an inclined degree. However, after practical usage by various users, it is discovered that the outlook of golf club bag A is not aesthetically pleasing due to the obvious extrusion of base C1 of support frame C against golf club bag A. Also, because base Cr and ground are in full contact, golf club bag A is not steady on the ground. With merely slightly push, it may fall down. Although some of the inventions of prior art, make base C1 foldable, the outlook of golf club bag A is still not aesthetically pleasing. The base C1 can easily be damaged. Thus, considering the various shortcomings of a prior art golf club, bag, there is a need to provide an improved golf club bag without the shortcomings of the prior art golf club.

SUMMARY OF THE INVENTION

The main objective of the invention is to provide a type of structurally improved support base for a golf club bag. A radiant hole is formed on one side of the base of a golf club bag to accommodate a movable base, which is located below the hole and is comparatively smaller than the inner edge of the hole. A support frame is equipped as a pin connection outside the bottom of the movable base. A pin connection is positioned at the upper portion for the stand of a golf club bag. The utmost upper portion for the stand of a golf club bag is connected with the golf club bag. When a support frame is pulled out to move outward against the golf club bag, the movable base is forced to slide upward and the whole golf club bag is supported in an appropriate degree with triangular supports of the base of a golf club bag, movable base, and stand of golf club bag. Due to the lifting movement of a movable base, golf clubs in the movable base are therefore extended outward to achieve the effects of steady standing of a golf club bag with a certain inclined angle, and is easy for users to reach the golf clubs and overall aesthetics in the outlook of a golf club bag are improved.

The secondary objective of the invention is to provide a kind of structure for the support base of a golf club bag. Segmental grooves can be produced on one side of the base of a golf club bag. A movable base is interlocked with the outer rim of the groove. A support frame and a movable base are connected as a pin. A pin connection is further functioned at the upper portion of the stand of a golf club bag. The utmost upper portion for the stand of a golf club bag is connected with the golf club bag. The design of pin connection is to achieve the effects of steady standing of a golf club bag with a certain angle, easy reach of golf clubs for users, and overall aesthetics in outlook of a golf club bag.

BRIEF DESCRIPTION OF THE DRAWINGS

FIG. 2-A is an assembly drawing of an embodiment of the invention.

FIG. 2-B shows the embodiment of the invention of FIG. 2-A in an operational demonstration.

FIG. 2-C is a partial cross-sectional view of the embodiment of FIG. 2-A.

FIG. 3-A is assembly drawing of another embodiment of the invention.

FIG. 3-B shows the embodiment of the invention of FIG. 3-A in an operational demonstration.

FIG. 3-C is a partial cross-sectional view of the embodiment of FIG. 3-A.

DETAILED DESCRIPTION OF THE INVENTION

Figure 1:
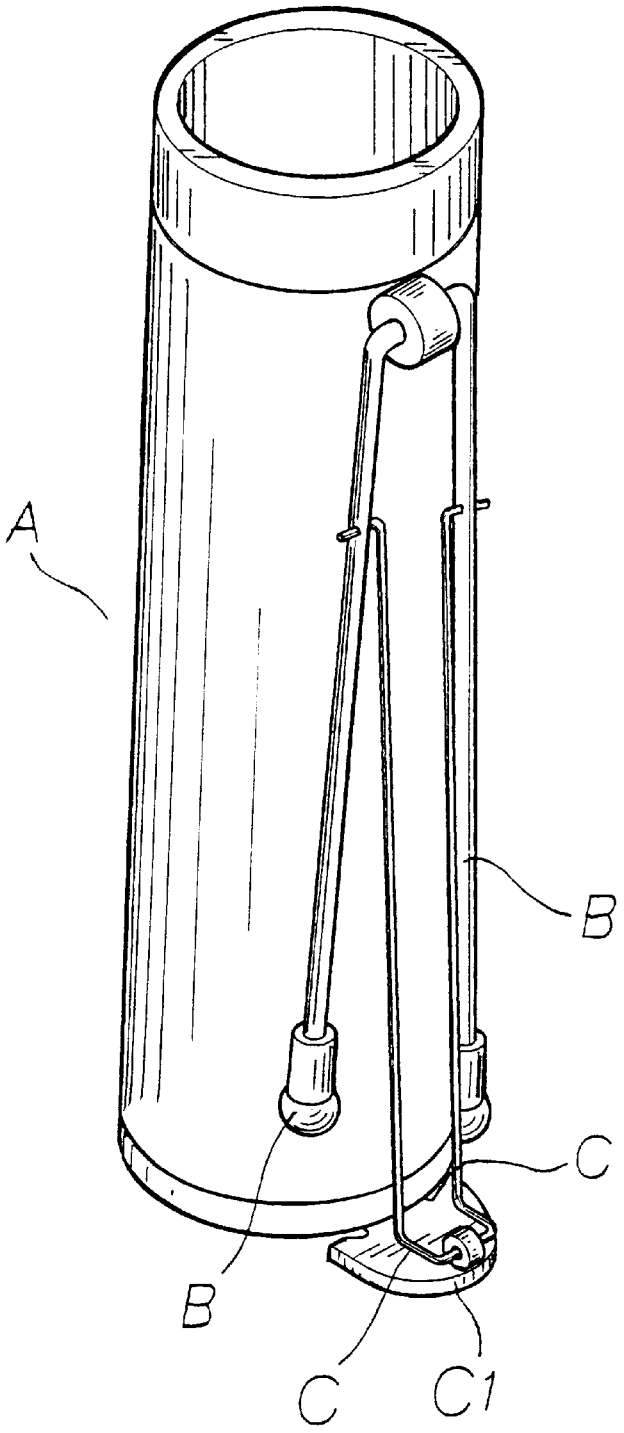
FIG. 1 PRIOR ART
FIG. 1 is a perspective view of a prior art golf club bag.

First, please refer FIGS. 2-A, 2-B, and 2-C. The invention is based on a type of support base for a golf club bag. A fully penetrated hole 21 is formed at one side of a lower base 2 of golf club bag 1. The lower base 2 includes an upper portion 2A and a lower portion 2B. Movable base 3 located below the hole is comparatively smaller than the inner edge of hole 21. The movable base 3 is movable up and down through the hole 21, as shown in FIG. 2-C. Support frame 4 is equipped as a pin connection, between the lower base 2 and a stand 5, outside the bottom of movable base 3. A pin connection is further set at the upper portion of support frame 4 and the stand 5 of a golf club bag. The utmost upper portion for the stand 5 of a golf club bag is connected with an upper base 9 which is attached to a golf club bag 1. Thus, when the stand 5 of golf club bag is pulled outward, the stand 5 of a golf club bag will force the support frame 4 to flex outwardly, as shown in FIG. 2-B. As a result, the support frame 4 forces the connected movable base 3 to move upward as shown in FIGS. 2-C and 2B as the weight of the golf club bag 1 shifts the movable base 3 upward, as shown in FIG. 2-B. The entire golf club bag i is supported at an appropriate tilt angle with the triple supports of the lower base 2 of golf club 1, the movable base 3, and the stand 5 of golf club bag as shown in FIG. 2-B. Also, because the movable base 3 is shifted upward, golf clubs 6 inside the movable base 3 are automatically extended upwardly and are easily reachable by users. Therefore, the invention not only can provide a steady stand for a golf club bag 1 tilted at a certain angle, but also enhances overall esthetics in outlook of the golf club bag 1.

In another embodiment, segmental groove 71 is formed at one side of a lower base 7 of the golf club bag 1. The lower base 7 includes an upper portion 7A and a lower portion 7B. Movable base 8, which functions similar to the movable base 3, is equipped at the outer rim of the groove 71 as shown in FIG. 3-A. Support frame 4 is connected with the bottom of the movable base 8. A pin connection is further set at the upper portion of the support frame 4 and stand 5 of a golf club bag. The upper portion of the stand 5 of a golf club bag is connected with an upper base 9 which is attached to a golf club bag 1. Thus, when stand 5 of golf club bag is pulled outward, the stand 5 of a golf club bag 1 will force the support frame 4 to flex outwardly as shown in FIG. 3-B. As a result, the support frame 4 forces the movable base 8 to move upward as shown in FIG. 3-C by the weight of the golf club bag 1 on the movable base 8. The golf club bag 1 is supported at an appropriate tilt angle with the triple supports of the lower base 7 of golf club bag 1, the movable base 8, and the stand 5 of golf club bag as shown in FIG. 3B. Also, because the movable base 8 is shifted upward, golf clubs 6 inside the movable base 8 are automatically extended upwardly and are easily reachable by users. Therefore, the invention not only can provide a steady stand for a golf club bag 1 tilted at a certain angle, but also enhances overall aesthetics in the outlook of a golf club bag 1.

The description of the embodiments above provides an improved performance over other prior art products.

What is claimed is:

1. A support base for a golf club bag, the support base comprising:

an upper base, the upper base comprising at least one through passage; a lower base (2) comprising an upper portion (2A) and a lower portion (2B);

a substantially cylindrical golf club bag (1) having first and second ends, the first end of the golf club bag attached to the upper base (9) and the lower base (2), forming an open cavity between the upper and lower bases;

a stand (5) pivotally connected to the upper base (9) and extending along the length of the golf club bag, near the lower base (2); a support frame (4) attached to the lower base (2) and pivotally connected to the stand (5); and the lower base (2) further comprising an opening (21) through which a movable base (3) is slidably attached, such that when the stand (5) is extended outwardly and rests on a ground, the support frame (4) flexes, the weight of the support base partially resting on the movable base (3) such that the movable base is forced upwards and the support base rests on the ground at a bottom portion of the stand (5), a bottom surface of the movable base (3) and a bottom surface of the lower base (2).

2. The support base for a golf club bag as claimed in claim 1 wherein the lower base (2) further comprises a segmental groove portion (71) on to which the movable base (3) is slidable and the support frame (4) is attached to the movable base.

* * * * *